US005345768A

United States Patent [19]

Washam et al.

[11] Patent Number: 5,345,768

[45] Date of Patent: Sep. 13, 1994

[54] DUAL-FUEL PRE-MIXING BURNER ASSEMBLY

[75] Inventors: Roy M. Washam, Schenectady; Robert A. Corr, II, Scotia, both of N.Y.

[73] Assignee: General Electric Company, Schenectady, N.Y.

[21] Appl. No.: 43,816

[22] Filed: Apr. 7, 1993

[51] Int. Cl.[5] ..... F23R 3/36

[52] U.S. Cl. ..... 60/737; 60/742

[58] Field of Search ..... 60/737, 742, 743, 748; 239/404, 405, 406

[56] References Cited

U.S. PATENT DOCUMENTS

| | | | |
|---|---|---|---|
| 3,605,405 | 9/1971 | Du Bell et al. | 60/748 |
| 3,853,273 | 12/1974 | Bahr et al. | 60/748 |
| 4,194,358 | 3/1980 | Stenger | 60/748 |
| 4,222,243 | 9/1980 | Mobsby | 60/748 |
| 4,982,570 | 1/1991 | Waslo et al. | 60/737 |
| 5,165,241 | 11/1992 | Joshi et al. | 60/748 |

*Primary Examiner*—Richard A. Bertsch
*Assistant Examiner*—Timothy S. Thorpe
*Attorney, Agent, or Firm*—Nixon & Vanderhye

[57] ABSTRACT

The burner assembly includes a flow body 12 having a central liquid fuel injection nozzle 14, inner and outer concentric passages 24 and 26, respectively, and a flow duct comprising a venturi downstream of the liquid injection nozzle. The inner passage 24 communicates air and gaseous fuel into the flow duct 16. Swirlers 30 and 38 are provided at the exit ends of the inner and outer passages, respectively, to create counterrotating flows which form a shear layer at the exit of the burner assembly body. The extent of the flow duct 16 facilitates liquid fuel atomization and vaporization, while affording sufficient time for gaseous fuel/air pre-mixing. The arrangement creates a recirculation zone 40 and a shear layer 42 at the exhaust of the burner assembly body which affords flame stabilization.

8 Claims, 1 Drawing Sheet

FIG. 1
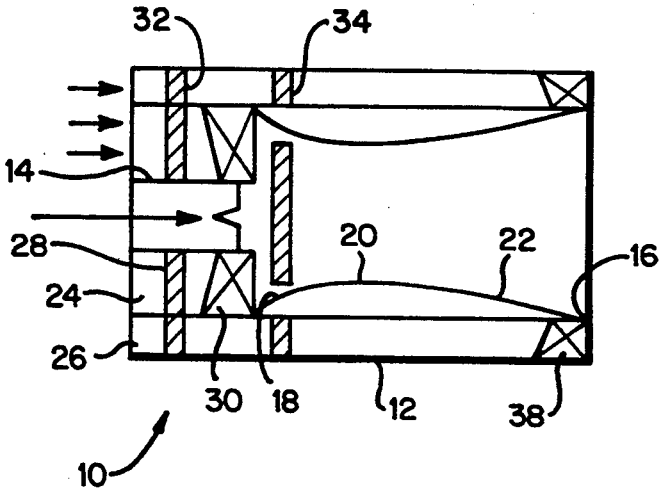
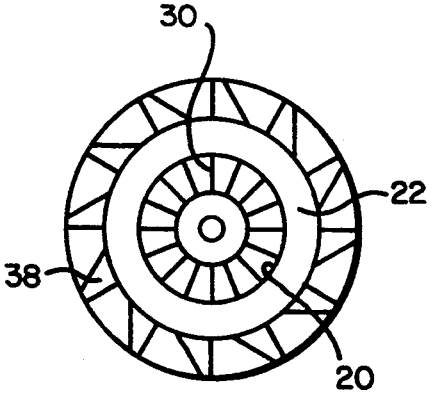
FIG. 2
FIG. 3
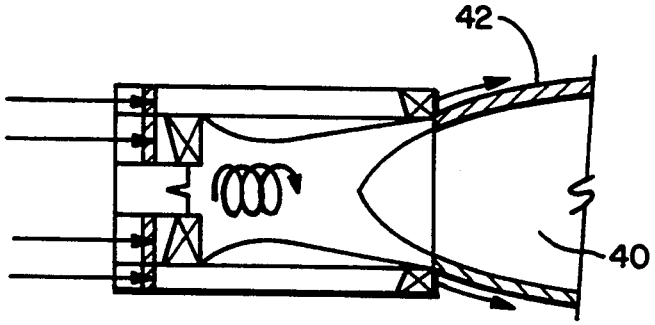

DUAL-FUEL PRE-MIXING BURNER ASSEMBLY

TECHNICAL FIELD

The present invention relates to a burner assembly for the combustor of a turbine and particularly relates to a dual-fuel pre-mixing burner assembly capable of using liquid and/or gaseous fuel in a lean pre-mixed mode.

BACKGROUND

Because of increasingly restrictive environmental regulations, there is a need to lower pollutant emissions for a variety of combustion applications. For machinery that uses steady flow combustion of either gaseous or relatively volatile liquid fuels with an overall excess of oxidant, lean pre-mixed combustion is a potential viable approach. Lean pre-mixed combustion tends to produce relatively low nitric oxide emissions because of its reduced flame temperature. Process parameters for lean pre-mixed methods of combustion involve vaporizing the fuel, if it is a liquid, mixing the fuel with air in excess of the air required to theoretically completely oxidize the fuel, and igniting and stabilizing the lean pre-mixed burning process. In practical terms, these steps are oftentimes not ideally realized because the hardware may not function as desired, may function only with substantial monitoring, control and complexity, or accomplish those steps quite imperfectly, producing relatively higher than theoretically achievable pollutant emissions. Accordingly, in terms of emission levels, simplicity and reliability, there are degrees of how well a particular lean pre-mixed design works.

A substantial number of lean pre-mixed combustion designs have been proposed in the past. Often, such designs include combustion systems which use gaseous fuel injection, liquid spray injection, swirling air flow, pre-mixing zones, lower flow speed, and flame stabilization regions. To the present, however, it has been a problem to combine liquid and gaseous fuel in a combustion process and apparatus to reliably achieve lean pre-mixed combustion.

DISCLOSURE OF THE INVENTION

In accordance with the present invention, there is provided a dual-fuel pre-mixing burner assembly which enables the introduction of air and either gaseous or liquid fuel, enhances the vaporization of the liquid fuel, promotes the pre-combustion mixing of fuel and air at lower fuel-to-air ratios for low $NO_x$ production, ensures the spatial stabilization of the combustion process, and promotes low acoustic activity from the burning process. More particularly, the present invention provides the foregoing as either a pilot for a more general process in a larger combustor or a burner component in a multi-burner combustor and which creates an effective liquid fuel lean pre-mixed burner compatible with gaseous fuel lean pre-mixed operation in the same pilot or burner component.

In a particular embodiment of the present invention, there is provided a burner assembly body having a central liquid fuel nozzle, a flow duct downstream of the liquid fuel nozzle, comprised of a convergent section, a throat section and a diverging section, and inner and outer concentric passages for delivering air or lean pre-mixed gaseous fuel to the flame zone. More particularly, the inner passage includes, at its outlet adjacent the converging section, a swirler for imparting a first tangential component of air flow into the flow duct.

The outer passage includes at its downstream exit an outer swirler for imparting a second tangential component of air flow to the flow region downstream of the burner body in a direction opposite to the first tangential direction. Gaseous injection nozzles are disposed, for example, in an annular array adjacent the inlet end of the inner passage upstream of the inner swirler and/or adjacent the inlet to the outer passage upstream of the outer swirler. Gaseous fuel injection nozzles may also be disposed in the converging section of the flow duct. Thus, liquid or gaseous fuel, or both, may be injected into the flow duct and pre-mixed with the air flowing through the inner passage to obtain a swirling lean pre-mixed fuel/air mixture at the exhaust of the diverging section. The converging section of the flow duct serves to damp out low-pressure pockets in the wake of the inner swirler and the fuel introduction that could lead to localized flame stabilization, accelerate the flow and thereby inhibit downstream flames from propagating into the planes of fuel introduction, provide time for gaseous fuel/air mixing and form a surface for liquid fuel to impinge upon and to coat. The diverging section expands the flow to a slower speed, prevents wall flow separation and provides an evaporation surface for the liquid fuel. The expansion at the exhaust of the flow duct, coupled with the residual swirl, establishes a centerline recirculation zone which aids in flame stabilization downstream of the burner body and enables heat to radiate back to the divergent section to facilitate vaporization of any liquid fuel coated on the divergent surfaces.

The outer flow swirler and the residual swirl imparted to the fuel/air mixture by the inner swirler form a shear flow layer downstream of the burner assembly body. This shear flow creates crossflow-induced drag forces on the fuel droplets entrained off the diverging section of the flow duct, tending to disintegrate and vaporize them more rapidly. The shear flow also causes a low-speed region that tends to stabilize the flame. By locating the outer swirler adjacent the exhaust of the burner assembly body and providing gaseous fuel in the outer passage, fuel can be introduced apart from the fuel injected in the vicinity of the inner swirler.

With the foregoing construction, the burner assembly creates a flow environment that facilitates liquid fuel vaporization, fuel/air pre-mixing and flame stabilization and which uniquely facilitates liquid fuel vaporization, while providing a structure affording extended time for gaseous fuel/air pre-mixing. Additionally, the recirculation zone at the exhaust centerline and the shear flow region at the exhaust outlet provide a dual means for flame stabilization. This redundancy enhances the flame stabilization necessary for low $NO_x$ production and decouples acoustic feedback phenomena, preventing dynamic pressure-induced hardware wear.

In a preferred embodiment according to the present invention, there is provided a dual-fuel pre-mixing burner assembly for a turbine, comprising a burner assembly body for flowing fuel and air in a generally downstream direction and having a liquid fuel nozzle disposed substantially centrally of and adjacent an inlet to the body for supplying liquid fuel for flow in the generally downstream direction, a flow duct carried by the body and having an upstream converging section, a throat section and a downstream diverging section for receiving fuel from the central nozzle and inner and outer generally concentric passages adjacent the body inlet for flowing air through the body, at least one gaseous fuel nozzle being carried by the body and located to flow gaseous fuel through the duct in the generally downstream direction, the inner passage lying in communication with the flow duct to supply air thereto for pre-mixing in the duct air and fuel from at least one of the central liquid fuel nozzle and the gaseous fuel nozzle for delivery of pre-mixed air and fuel to a flow region downstream of the duct to establish a burner flame. An inner swirler is provided in the inner passage for delivering to the duct air having a flow component in a first tangential direction such that the pre-mixed fuel and air delivered from the duct to the flow region has a flow component in the first tangential direction, the pre-mixed fuel and air exiting the converging section of the duct establishing a centerline recirculation zone in the flow region to afford flame stabilization. An outer swirler in the outer passage delivers to the flow region downstream of the duct air having a flow component in a second tangential direction generally opposite to the first tangential direction for establishing with the flow having the first tangential component a generally annular shear layer in the flow region, the centerline recirculation zone and the annular shear layer facilitating flame stabilization in the burner assembly.

In a further preferred embodiment according to the present invention, there is provided a dual-fuel pre-mixing burner assembly for a turbine having a burner assembly body, a liquid fuel nozzle disposed substantially centrally of and adjacent an inlet to the body, a flow duct carried by the body and including an upstream converging section, a throat section and a downstream diverging section, inner and outer generally concentric passages adjacent the body inlet, and at least one gaseous fuel nozzle carried by the body, there is provided a method of combustion comprising the steps of flowing fuel from the liquid fuel injection nozzle into the flow duct for flow in a generally downstream direction, introducing air through the inner passage into the flow duct having flow components in a first generally tangential direction and the generally downstream direction for mixing in the flow duct with the liquid fuel and affording a swirl to the flow exhausting from the diverging section, establishing downstream of the burner body a recirculation zone resultant from expanding the swirling exhaust flow from the diverging section of the flow duct to afford flame stabilization, flowing air through the outer passage bypassing the flow duct into a flow region downstream of the burner body with a flow component in a second generally tangential direction opposite the first tangential direction to establish therewith a shear flow layer in the downstream flow region to further afford flame stabilization, and flowing gaseous fuel into the flow duct from the gaseous fuel nozzle for combining with the liquid fuel/air flow through the flow duct to obtain a lean pre-mixed fuel flow for reduced emissions.

Accordingly, it is a primary object of the present invention to provide a burner assembly that promotes substantial liquid/fuel pre-vaporization and pre-mixing, stabilizes lean pre-mixed flames in an effective and acoustically quiet manner, and accommodates lean pre-mixed gaseous fuel operation.

BRIEF DESCRIPTION OF THE DRAWINGS

FIG. 1 is a schematic longitudinal cross-sectional through a burner assembly constructed in accordance with the present invention;

FIG. 2 is an end view thereof; and

FIG. 3 is a view similar to FIG. 1 illustrating operational parameters of the burner assembly hereof.

BEST MODE FOR CARRYING OUT THE INVENTION

Reference will now be made in detail to a present preferred embodiment of the invention, an example of which is illustrated in the accompanying drawings.

Referring now to the drawings, particularly to FIG. 1, there is illustrated a burner assembly constructed in accordance with the present invention and generally designated 10, including a burner assembly body 12 having adjacent an inlet or upstream end thereof, a liquid fuel injection nozzle 14 disposed centrally of the body for injecting atomized liquid fuel into a flow duct 16. Flow duct 16 includes a venturi having a converging section 18, a throat 20 and a diverging section 22. A pair of concentric inner and outer passages 24 and 26, respectively, surround the liquid fuel nozzle 14 adjacent the inlet end of the burner assembly body 12. The inner passage 24 exits into the flow duct 16 directly adjacent the converging section 18. The outer passage 26 bypasses the flow duct 16 and flows air the length of the burner assembly body 12 to exit into a flow region including a flame zone downstream of the body 12.

Gaseous fuel injection planes are illustrated in FIG. 1. For example, a gaseous fuel injection plane 28 is located in the inner passage 24 upstream of inner swirler blades 30 disposed at the exit of inner passage 24 upstream of the converging section 18. A gaseous fuel injection plane may be located downstream of the liquid fuel injection nozzle 14. Additionally, one or more gaseous fuel injection planes 32 and 34 may be provided in the outer passage 26. To create the gaseous fuel injection planes, one or more gas fuel injection nozzles, not shown, is provided to supply gaseous fuel in the planes. It will be appreciated that the gaseous fuel injection nozzles, as well as the liquid fuel injection nozzle as used in the present invention, are conventional in construction and per se form no part of the present invention. Additionally, a plurality of outer swirler blades 38 are disposed adjacent the flow exit of outer passage 26. For reasons which will become apparent, the inner and outer swirler blades 30 and 38 impart first and second tangential components of flow in opposite circumferential directions.

In use, the centerline fuel delivery system comprises a dual-fuel system, i.e., has a liquid fuel subsystem comprised of the liquid fuel injection nozzle 14 and a gaseous fuel subsystem comprised of the one or more gaseous fuel nozzles in the inner passage. The liquid fuel may be injected as a swirling, hollow, conical spray along the centerline of the flow in a generally downstream direction. Either a substantial liquid/fuel pressure loss is used to produce the spray or the process may be assisted by a dedicated flow of relatively high velocity air to facilitate atomization. The gaseous fuel may be injected from one or more of the nozzles to achieve a substantially uniform or homogenous spatial distribution of the fuel to facilitate homogenous fuel/air mixing. The inner swirler 30 imparts a first tangential component to the air, if only liquid fuel injection is used, or to the gaseous fuel/air mixture if gaseous fuel is employed. As indicated, the gaseous fuel injection may be either upstream or downstream of the inner swirler, the liquid fuel injection being downstream of the inner swirler.

As the fuel flows downstream from the liquid injection nozzle or the gaseous fuel injection nozzles, or both, the converging section 18 of flow duct 16 damps out low-pressure pockets in the wake of inner swirler 30 and the fuel introduction that could lead to localized flame stabilization, accelerates the flow to inhibit downstream flames from propagating into the planes of the fuel introduction, provides time for gaseous fuel/air mixing where gaseous fuel is used, and affords a surface for liquid fuel to impinge upon and to coat. The diverging section 22 expands the flow to a slower velocity, prevents wall flow separation and provides an evaporation surface for the liquid fuel. The flow duct also serves to provide a pre-mixing zone between the nozzle and the flame to afford a lean pre-mixed burn providing lower $NO_x$ emissions.

At the outlet of the flow duct 16, the expansion of the exhaust flow from the diverging section of the flow duct couples with the residual swirl to establish a centerline lower pressure recirculation zone 40 downstream of the burner assembly body. This recirculation zone facilitates flame stabilization and enables heat to radiate back to the diverging section to further vaporize any liquid fuel coated on those surfaces. The inner and outer flow swirlers 30 and 38, respectively, also create an annular shear flow layer or region 42 due to their counterrotating flows to further facilitate atomization of the liquid fuel and flame stabilization. The cross-flow induced drag forces on the fuel droplets entrained off the downstream edge of the flow duct are disintegrated by the shear flow layer into smaller droplets for more effective vaporization. This dissipative shear flow tends to cause low-speed regions that can stabilize the flame. Note also that gaseous fuel may be introduced into the downstream flow region by the outer swirler apart from the fuel injected into the flow region along the flow duct.

In the present burner assembly, the body may have a length of between 12–15 inches and an outer diameter of about 5 inches. The throat 20 may have a diameter of about 3 inches, while the exit diameter of the flow duct 16 may be about 4 inches.

Consequently, it will be appreciated that the burner assembly creates a flow environment that facilitates liquid fuel vaporization, fuel/air pre-mixing and flame stabilization. Importantly, the liquid fuel vaporization is facilitated, while simultaneously affording extended time for gaseous fuel/air pre-mixing. Additionally, the recirculation zone and the shear flow region at the exhaust from the flow duct provide a dual mechanism for flame stabilization.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A dual-fuel pre-mixing burner assembly for a turbine, comprising:

a burner assembly body having an inlet for flowing fuel and air in a generally downstream direction and having a liquid fuel nozzle disposed substantially centrally of and adjacent said inlet to said body for supplying liquid fuel for flow in the generally downstream direction;

a flow duct, carried by said body and having an upstream converging section, a throat section and a downstream diverging section, for receiving fuel from central nozzle and air from said inlet;

inner and outer generally concentric passages adjacent said body inlet for flowing air through said body;

at least one gaseous fuel nozzle carried by said body and located to flow gaseous fuel through said duct in the generally downstream direction;

said inner passage lying in communication with said flow duct to supply air thereto for pre-mixing, in said duct, air and fuel from at least one of said central liquid fuel nozzle and said gaseous fuel nozzle to form a lean air fuel mixture and for delivery of said pre-mixed air and fuel to a flow region downstream of said duct;

an inner swirler in said inner passage for delivering to said duct air having a flow component in a first tangential direction such that the pre-mixed fuel and air delivered from said duct to said flow region has a flow component in said first tangential direction;

said converging section of said duct and said pre-mixed fuel and air, exiting said converging section of said duct, comprising a means for establishing a centerline recirculation zone in said flow region therefore affording flame stabilization; and an outer swirler means in said outer passage for delivering to said flow region downstream of said duct air having a flow component in a second tangential direction generally opposite to said first tangential direction and for establishing, in combination with the flow having said first tangential component, a generally annular shear layer in said flow region, said centerline recirculation zone and said annular shear layer comprising a means for flame stabilization in said burner assembly.

2. A burner assembly according to claim 1 wherein said one gaseous fuel nozzle is located adjacent an inlet to said inner passage upstream of said inner swirler.

3. A burner assembly according to claim 1 wherein said one gaseous fuel nozzle is located in said flow duct downstream of said inner swirler.

4. A burner assembly according to claim 1 including a gaseous fuel nozzle carried by said body in said outer passage upstream of said outer means.

5. A burner assembly according to claim 1 wherein said converging section comprising a means for accelerating the flow through said duct, for inhibiting the downstream flame from propagating back toward the fuel nozzles, for affording sufficient time for mixing fuel and air to provide a lean pre-mixed mixture for combustion and for providing a surface for the liquid fuel to impinge and coat.

6. A burner assembly according to claim 5 wherein said diverging section comprises a means for expanding the flow to a slower velocity, for preventing wall flow separation and for providing an evaporation surface for the liquid fuel.

7. In a dual-fuel pre-mixing burner assembly for a turbine having a burner assembly body, a liquid fuel nozzle disposed substantially centrally of and adjacent an inlet to said body, a flow duct carried by said body, said duct including an upstream converging section, a throat section and a downstream diverging section, inner and outer generally concentric passages adjacent said body inlet, and at least one gaseous fuel nozzle carried by said body, a method of combustion comprising the steps of:

flowing fuel from said liquid fuel injection nozzle into said flow duct for flow in a generally downstream direction;

introducing air through said inner passage into said flow duct having flow components in a first generally tangential direction and said generally downstream direction for mixing in said flow duct with said liquid fuel and affording a swirl to the flow exhausting from said diverging section;

establishing downstream of said burner body a recirculation zone resultant from expanding the swirling exhaust flow from the diverging section of the flow duct to afford flame stabilization;

flowing air through said outer passage bypassing said flow duct into a flow region downstream of said burner body with a flow component in a second generally tangential direction opposite said first tangential direction to establish therewith a shear flow layer in said downstream flow region to further afford flame stabilization; and flowing gaseous fuel into said flow duct from said gaseous fuel nozzle for combining with the liquid fuel/air flow through said flow duct to obtain a lean pre-mixed fuel flow for reduced emissions.

8. A pre-mixing burner assembly for a turbine, comprising:

a burner assembly body having an inlet for flowing fuel and air in a generally downstream direction and having a fuel nozzle disposed substantially centrally of and adjacent said inlet to said body for supplying fuel for flow in the generally downstream direction;

a flow duct, carried by said body and having an upstream converging section, a throat section and a downstream diverging section, for receiving fuel from said central nozzle and air from said inlet;

inner and outer generally concentric passages adjacent said body inlet for flowing air through said body;

at least one gaseous fuel nozzle carried by said body and located to flow gaseous fuel through said duct in the generally downstream direction;

said inner passage lying in communication with said flow duct to supply air thereto for pre-mixing, in said duct, air and fuel to form a lean air and fuel mixture from said at least one of said central liquid fuel nozzle and said gaseous fuel nozzle and for delivery of said pre-mixed air and fuel to a flow region downstream of said duct;

an inner swirler in said inner passage for delivering to said duct air having a flow component in a first tangential direction such that the pre-mixed fuel and air delivered from said duct to said flow region has a flow component in said first tangential direction;

said converging section of said duct and said pre-mixed fuel and air, exiting said converging section of said duct, comprising a means for establishing a centerline recirculation zone in said flow region therefore affording flame stabilization; and an outer swirler means in said outer passage for delivering to said flow region downstream of said duct air having a flow component in a second tangential direction generally opposite to said first tangential direction and for establishing, in combination with the flow having said first tangential component, a generally annular shear layer in said flow region, said centerline recirculation zone and said annular shear layer comprising a means for flame stabilization in said burner assembly.

* * * * *